United States Patent [19]

Closmann et al.

[11] Patent Number: 4,514,283

[45] Date of Patent: Apr. 30, 1985

[54] PROCESS FOR SEPARATING AND CONVERTING HEAVY OIL ASPHALTENES IN A FIELD LOCATION

[75] Inventors: Philip J. Closmann; Monroe H. Waxman; Charles T. Deeds, all of Houston, Tex.

[73] Assignee: Shell Oil Company, Houston, Tex.

[21] Appl. No.: 574,303

[22] Filed: Jan. 26, 1984

[51] Int. Cl.[3] ..... C10G 53/04; C10G 55/04

[52] U.S. Cl. ..... 208/86; 208/370

[58] Field of Search ..... 208/370, 86, 309

[56] References Cited

U.S. PATENT DOCUMENTS

| | | | |
|---|---|---|---|
| 2,875,149 | 2/1959 | Beavon | 208/73 |
| 3,369,992 | 2/1968 | Henke et al. | 208/14 |
| 3,775,293 | 11/1973 | Watkins | 208/86 |
| 4,172,026 | 10/1979 | Jensen | 208/14 |
| 4,391,701 | 7/1983 | Le Page et al. | 208/370 |
| 4,428,824 | 1/1984 | Choi et al. | 208/86 |

*Primary Examiner*—Delbert E. Gantz
*Assistant Examiner*—O. Chaudhuri

[57] ABSTRACT

Viscous asphaltenic crude oils are converted to pumpable liquid oil products in field locations by precipitating and separating asphaltenes, then mildly thermally converting the asphaltenes to mobile asphaltene-conversion products that can be mixed with at least the maltene components of the crude oils to form the pumpable liquid oil products.

5 Claims, No Drawings

PROCESS FOR SEPARATING AND CONVERTING HEAVY OIL ASPHALTENES IN A FIELD LOCATION

BACKGROUND OF THE INVENTION

This invention relates to producing a viscous heavy oil and treating it in a field location by diluting the oil with conversion products of its asphaltenes to provide a pumpable liquid oil product.

Numerous prior processes for treating viscous heavy oils have been described in patents and publications such as the following:

In 1941 an article by M. W. Ball, "Development of the Athabasca Oil Sands," Canadian Institute of Mining and Metallurgy Transactions, Volume XLIV, pages 59–91, indicated that the crude oil obtained from Athabasca tar sands is uniquely susceptible to digestion at mild temperatures and relatively long times; which can provide a change in API gravity such as from as low as about 10 to more than 20.

In 1964, an article by J. G. Erdman and J. P. Dickie, "Mild Thermal Alteration of Asphaltic Crude Oils", Symposium on Asphalt: Composition, Chemistry and Physics, presented before the Division of Petroleum Chemistry, American Chemical Society, Philadelphia Meeting, April 5–10, stated, "That asphaltic crude oils and particularly asphaltic petroleum bottoms are liable to heat is well known, the process of 'visbreaking' having been practiced in petroleum refinery for many years" (page B-69). The authors indicated that, "If the results obtained on the fractions of crude oil are paralleled, at least approximately in the whole crude or in a vacuum residium, a more stable residual fuel oil might be obtained by deasphalting visbreaking the remainder, followed by reconstitution" (page B-77).

In 1978 an article in Fuel, Volume 57, July 1978, by G. E. Moschopedis, S. Parkash and J. G. Speight, "Thermal Decomposition of Asphaltenes," indicated that the thermal decomposition of Athabasca asphaltenes occurred readily at a variety of temperatures to yield products varying from low-molecular-weight gases to presumably high-molecular-weight materials that are insoluble in benzene. In 1983, writing for the Distinguished Author Series, M. A. Carrigy on "Thermal Recovery From Tar Sands, " December 1983, JPT pp. 2149, states that "Probably the most significant lesson that has been learned from the many field tests in tar sands is that unpredictable variability in the reservoir is the most important factor initiating against the success of field experiments."

In 1980, SPE Paper 9510 by M. H. Waxman, C. T. Deeds and P. J. Closmann described laboratory work for obtaining mobility data regarding tar from Peace River Bullhead Sand in its parent core material at conditions simulating those involved in a steam drive oil recovery process. Asphaltene components of the tar were separated and heated at 572° F. for 240 hours. That work indicated that, "The soluble asphaltenes became less stable in their maltene solutions" (page 4) and it was concluded that, "The ability of these altered asphaltenes to interact with organic solvents and/or their maltenes is reduced" (page 8). In addition, it was found that when the maltenes remaining after the removal of the asphaltenes were heated for times and temperatures such as 572° F. for 240 hours or 617° F. for 406 hours these treatments produced asphaltenes in the amounts of, respectively, 0.64 and 18.78% by weight.

Several United States patents relates to utilizing thermal alteration of heavy crude oils or their components. U.S. Pat. No. 3,442,333 describes upgrading heavy crude oil as it is being produced in the field by heating it in tubing strings and/or casings, at from about 550° to 700° F. for at least 24 hours. U.S. Pat. No. 3,554,285 describes upgrading crude oil by heating a reservoir to at least 550° F. and inflowing crude oil and keeping it within the heated reservoir long enough to effect an upgrading of the oil.

Various patents such as U.S. Pat. Nos. 4,169,782; 4,294,686; 4,390,410 and 4,284,139 describe various ways of improving the refining of heavy crude oils by utilizing relatively mild visbreaking treatments in conjunction with other conventional refining treatments.

SUMMARY OF THE INVENTION

The present invention relates to a process for treating at least the relatively high boiling components of a viscous crude oil in a field location to produce a pumpable liquid oil product. The asphaltenic components of the crude oil or its heavy ends are precipitated and separated by mixing the oil with an asphaltene precipitating agent which is at least as effective for precipitating asphaltenes as is normal heptane. The asphaltenes are then heated at a pressure of from about one to three atmospheres to convert them to mobile asphaltene-conversion products. The time and temperature conditions of the heating are at least substantially as effective for yielding said conversion products without significant coking as heating at substantially atmospheric pressure for about 1 to 3 days at temperatures of from 625° F. to 700° F. In In a preferred embodiment the asphaltene precipitating agent is a volatile gaseous or liquid fluid which is reused after being distilled and recovered from the maltene components of the crude oil from which the asphaltenes were precipitated. At least the mobile asphaltene-conversion products and the maltene components of the crude oil are blended together in proportions providing a pumpable liquid oil product having a viscosity of not more than about 10,000 centipoise.

DESCRIPTION OF THE INVENTION

As indicated by the prior patents and journal publications, numerous procedures have been proposed and numerous theories have been presented regarding how and/or why particular ones of crude oils or crude oil fractions can be, or have been, thermally altered and/or upgraded to provide less viscous materials. In general, the prior treatments have required the heating of large volumes of oil in the field locations. Applicants have now discovered that when the asphaltene components of a produced heavy crude oil are separated and only the separated asphaltenes are slowly and mildly heated to effect a thermal conversion, the kind and amount of the so produced asphaltene-conversion products make it feasible to combine at least those materials with the maltene components of the crude oil or crude oil fraction to form a liquid oil product which can readily be pumped through pipelines. Unobviously, this is at least substantially as effective as treating the whole tar or a vacuum flasher bottoms (boiling above about 900° F.) and is economically advantageous since the thermal process is applied to a smaller fraction.

Laboratory Tests

A 1-part by volume portion of Peace River tar was mixed with 100 parts by volume of normal pentane at room temperature and atmospheric pressure. The treatment precipitated 20.34 percent by weight of asphaltenes. The precipitates were separated by filtration. Separate portions of the so isolated asphaltenes were heated at 660° F. for, respectively, 1 day and 3 days. The heating was conducted at substantially atmospheric pressure with the evolved gases and liquid being allowed to leave the system. The gases were passed through Drierite desiccant and then collected in plastic bags. At the conclusions of the tests the gases were collected over water. During the tests the vaporized hydrocarbons were collected in a graduated cylinder. At the ends of the tests the thermally altered asphaltenes, the thermally generated mobile liquid asphaltene-conversion products, and the maltene components of the crude oil were blended together in the proportions of their generation. It was found that those materials formed a substantially homogeneous solution or dispersion when they were mixed at a temperature near but generally less than about 113° F.

In order to ensure the homogeneity for analysis, vessels in which the mixtures were contained were rotated continuously for about one month at about 6 rpm. After this treatment the viscosities were measured, by standard analytical procedures, and the results are shown in Table 1, along with measurements of Peace River crude oil maltenes for comparison.

TABLE 1

RESULTS OF HEATING PEACE RIVER TAR - VISCOSITIES

| Sample | Viscosity CS 77° F. | Viscosity Reduction Factor | Viscosity CS 125° F. | Viscosity Reduction Factor | CSF 180° F. | Reduction Factor |
|---|---|---|---|---|---|---|
| Unaltered Extracted Tar | 137,200 | | 6030 | | 582.0 | |
| 1-Day Heated Asphaltenes + Maltenes + Distillate | 21,590 | 6.4 | 1608 | 3.8 | 215.9 | 2.7 |
| 3-Day Heated Asphaltenes + Maltenes + Distillate | 2,463 | 56 | 295.2 | 20 | 59.3 | 9.7 |
| Original Maltenes (API Gravity = 10.63) | 4,961 | 28 | 462.8 | 13 | 78.8 | 13.5 |
| Original Maltenes + Distillate (3-day Heated) | 2,347 | 58 | 276.8 | 22 | 55.0 | 10.6 |

NOTE: Viscosity Reduction factor = $\frac{\text{original viscosity}}{\text{final viscosity}}$ As indicated in Table 1 the untreated crude oil had a viscosity at 77° F. of 137,200 centipoise. But, the viscosity of the treated oil was only 2,463 cp when the separated asphaltenes were heated for 3 days. The treated oil viscosity was only 21,090 cp when the separated asphaltenes were heated for just one day.

The results of a sulfur analysis of Peace River tar components are shown in Table 2.

TABLE 2

SULFUR ANALYSES OF PEACE RIVER TAR COMPONENTS

| SAMPLE | WEIGHT PERCENTAGE SULFUR |
|---|---|
| Original Tar | 6.2 |
| Asphaltenes | 9.3 |
| Maltenes | 5.7 |
| 1-Day Heated Asphaltenes | 8.0 |
| 3-Day Heated Asphaltenes | 7.5 |

TABLE 2-continued

SULFUR ANALYSES OF PEACE RIVER TAR COMPONENTS

| SAMPLE | WEIGHT PERCENTAGE SULFUR |
|---|---|
| 1-Day Distillate | 2.9 |
| 3-Day Distillate | 4.8 |

As indicated in Table 2, there is a net loss of sulfur mainly by way of sulfur compounds being incorporated within the gas phase.

As indicated by the tests, the efficiency of the thermally generated mobile asphaltene-conversion products in reducing the viscosity of the oil from which they were derived is very high. In addition, a significant proportion of sulfur is converted to gaseous materials. These factors combine to provide a high degree of flexibility for the users of the process. In addition, in the light of prior indications that such a heating of the maltenes present in such an oil converts maltenes to asphaltenes, relative to a process for similarly heating the whole crude oil, the present process saves energy by avoiding the forming of some asphaltenes while or before converting them or other asphaltenes to thermally-generated asphaltenes-conversion products.

In a thermal process for recovering a heavy oil a significant proportion of the oil can advantageously be used as fuel. In using the present process much or all of that fuel can comprise the residual heated-asphaltenes or a mixture of those materials with the gaseous products of the asphaltene heating operation. In the latter operation the sulfur compounds can readily be disposed of by known stack gas scrubbing procedures.

Compositions and Procedures

In general, the present invention is applicable to substantially any asphaltenic heavy crude oil having a viscosity high enough to make it infeasible for pipeline transportation. Particularly suitable crude oils are those in which the amount of asphaltenic components are at least about 5% by wt, the asphaltenic components are like those in Peace River tar with respect to precipitating a significant proportion of asphaltenes when contacted with normal pentane, or other asphaltene-precipitating agents, and, when the asphaltenic components are heated for 1 to 3 days at from about 625° F. to 700° F., they yield as significant proportion of non-viscous thermal conversion products, such as the proportion yielded by the asphaltenic components of Peace River tar.

Suitable volatile asphaltene precipitating agents for use in this process can comprise substantially any which are more volatile than water and are at least substantially as efficient regarding the precipitation of asphaltenes as normal pentane. Particularly suitable precipitating agents are very volatile materials such as propane, butane, isobutane, mixtures of $C_3$, $C_4$ and $C_5$ saturated hydrocarbons, and the like.

The mixing of the asphaltene precipitating agent with the crude oil can be done continuously or intermittently. The separating of the precipitated asphaltenes can also be done continuously or batchwise. The mixing, separating and heating devices used for precipitating and separating can suitably be those conventionally available.

The thermal converting of the asphaltenes can suitably be conducted by continuously or intermittently heating them for a time and at a temperature at least substantially equivalent, with respect to yielding non-viscous asphaltene-conversion products without significant coke formation, to heating for from about 1 to 3 days at from 625° F. to 670° F. Particularly suitable conditions are those at least equivalent to a continuous heating at about 650° F. to 670° F. for about 3 days. It may be desirable to conduct the heating at slightly elevated pressures, such as from about 1 to 3 atmospheres. This may reduce the amount of gaseous thermal conversion products which are formed without requiring treating vessels more costly than conventional spherical or "bullet" type vessels.

In a particularly preferred procedure the crude oil is dewatered before the asphaltene precipitating agent is added. In addition it may be desirable to distill the light ends, such as those boiling below about 900° F., from the dewatered crude oil before adding the asphaltene precipitating agent.

The asphaltene precipitating agent which is used is preferably a highly volatile compound, such as propane. After the asphaltenic components have been removed at least a significant proportion of the volatile asphaltene precipitating agent is preferably distilled and recovered for re-use from both the asphaltenic and non-asphaltenic components of the crude oil.

The heating of the separated asphaltenic components can be done in either a substantially continuous or batch-wise manner. Other diluents such as light fractions from the same oil, or the like, are preferably blended with the produced crude oil, along with the products of thermally converting the separated asphaltenes. Preferably, enough of at least the non-viscous asphaltene-conversion products are blended with the relatively aspaltene-free components of the crude oil or heavy ends of the crude oil from which asphaltenic components have been precipitated to maintain a substantially continuous production of a liquid oil product having a viscosity of less than about 10,000 centipoise. The heated but relatively unconverted asphaltenic components which reman solid or viscous throughout the heat conversion process and/or the coke or other solids formed during that process are preferably utilized at the well site for fuel, or simply transported as suspended solids within the oil product.

What is claimed is:

1. A process for treating at least the relatively high boiling components of an asphaltenic viscous crude oil in a field location, in order to produce a pumpable liquid oil product, comprising:

mixing the crude oil or its heavy ends with an asphaltene precipitating agent at least as effective for asphaltene precipitation as normal heptane and recovering at least a portion of the precipitated asphaltenic components of the crude oil;

thermally converting the recovered asphaltenic components to non-viscous liquid asphaltenic conversion products by heating said recovered asphaltenic components at a pressure of from about one to three atmospheres for a time and temperature substantially as effective as heating said recovered asphaltenic components at substantially atmospheric pressure at from about 625° F. to 700° F. for from about one to three days; and mixing products of said conversion comprising the non-viscous liquid asphaltenic conversion products with at least the maltene components of the crude oil or its heavy ends from which asphaltenic components were precipitated in order to form a pumpable liquid oil product having a viscosity of no more than about 10,000 centipoise.

2. The process of claim 1 in which the asphaltene precipitating agent is normal pentane.

3. The process of claim 1 in which the asphaltene precipitating agent is more volatile than normal pentane.

4. The process of claim 1 in which the crude oil is Peace River tar.

5. The process of claim 4 in which the asphaltenes are heated for about three days.

* * * * *